United States Patent [19]

Clerbois et al.

[11] 4,049,532

[45] Sept. 20, 1977

[54] ELECTRODES FOR ELECTROCHEMICAL PROCESSES

[75] Inventors: Lucien Clerbois, Vilvoorde; Louis Degueldre, Brussels, both of Belgium; Christian Biver, Hagen, Luxembourg; Albert Degols, Berg; Yves Gobillon, Brussels, both of Belgium

[73] Assignee: Solvay & Cie., Brussels, Belgium

[21] Appl. No.: 508,391

[22] Filed: Sept. 23, 1974

Related U.S. Application Data

[63] Continuation of Ser. No. 258,539, June 1, 1972, abandoned.

[30] Foreign Application Priority Data

June 2, 1971 Luxembourg ..... 63263
May 4, 1972 Luxembourg ..... 65296

[51] Int. Cl.[2] ..... C25B 11/10

[52] U.S. Cl. ..... 204/290 F; 427/123; 427/126; 427/404; 427/405; 427/419 A; 427/419 B

[58] Field of Search ..... 204/290 F; 427/123, 427/126, 404, 405, 419 A, 419 B, 419 F

[56] References Cited

U.S. PATENT DOCUMENTS

| | | | |
|---|---|---|---|
| 3,491,014 | 1/1970 | Bianchi et al. | 204/290 F |
| 3,547,600 | 12/1970 | Gwynn et al. | 29/194 |
| 3,562,008 | 2/1971 | Martinsons | 117/230 |
| 3,672,990 | 6/1972 | Beck et al. | 204/290 F |
| 3,689,383 | 9/1972 | De Witt | 204/95 |
| 3,701,724 | 10/1972 | Entwisle et al. | 204/290 F |
| 3,711,385 | 1/1973 | Beer | 204/290 F |
| 3,761,385 | 9/1973 | Ruthel et al. | 204/290 F |
| 3,839,181 | 10/1974 | Degueldre et al. | 204/290 F |
| 3,846,273 | 11/1974 | Bianchi et al. | 204/290 F |

*Primary Examiner*—T. Tung
*Attorney, Agent, or Firm*—Spencer & Kaye

[57] ABSTRACT

A coating composition for application to an electrically conductive and relatively inert support at least the surface layer of which is titanium or a titanium alloy, to form a coated electrode for electrochemical processes, the composition essentially containing thermally decomposable compounds of iridium and of at least one non noble element selected from the group consisting of lithium, boron, beryllium, magnesium, gallium and germanium, in a liquid vehicle, the atomic ratio of iridium/non noble element being between 1/4 and 8/1. An electrode provided with a coating of this composition exhibits, inter alia, increased service life.

12 Claims, No Drawings

ELECTRODES FOR ELECTROCHEMICAL PROCESSES

CROSS REFERENCE TO RELATED APPLICATION

This application is a continuation of copending Application Ser. No. 258,539, filed June 1st, 1972, now abandoned.

BACKGROUND OF THE INVENTION

The present invention relates to electrodes for electrochemical processes, and particularly electrodes composed of a relatively inert metallic support at least an outer layer of which is made of titanium or a titanium alloy and optionally containing a core of a better conducting metal, for example copper, iron, aluminum or an alloy of these metals and a protective coating with electrocatalytic properties containing at least one noble metal and/or an oxide thereof.

The electrodes according to the present invention can be used in various electrochemical processes, such as cathodic protection, desalination or purification of water, electrolysis of water or hydrochloric acid, production of current in a fuel cell, reduction or oxidation of organic compounds or the electrolytic manufacture of persalts, but they are particularly useful as anodes in the electrolysis of aqueous solutions of alkali metal halides, particularly sodium chloride, in both diaphragm cells and mercury cells, where they catalyze the discharge of chloride ions which takes place at a remarkably low and practically constant overpotential throughout the life of the electrode. Under the conditions existing in the cell, the rate of wear of such anodes is negligible, which means that they have a practically unlimited life and eliminate the laborious operation of opening the cell and replacing the electrodes.

Although known electrodes are remarkably resistant to electrochemical attack in a good number of corrosive media, the substrate made of titanium or titanium alloy is nevertheless not completely inert, particularly used as an anode support in the electrolysis of aqueous solutions of alkali metal chlorides, where they suffer subsurface corrosion by the chlorinated brine which infiltrates through bare patches, pores, or fissures present in the conventional coatings. This in time inevitably causes detachment of the coating from its substrate through localized peeling, thus appreciably increasing the overpotential for liberation of chlorine and thereby reducing the effective life of the electrode, which sooner or later will have to be replaced.

SUMMARY OF THE INVENTION

One object of the invention is to increase considerably the resistance to electrochemical attack, particularly by chlorinated brine, of the titanium or titanium alloy substrate of such an electrode.

Another object of the invention is to produce on the surface of the substrate a protective and electrocatalytic coating which is substnatially free from bare batches, pores or fissures and adheres perfectly to the substrate.

Yet another object of the invention is to produce an electrode with a long life and high stability over a period of time, having outstanding electrocatalytic properties, particularly in the electrolysis of brine.

A further object of the invention is to provide a process for the manufacture of such an electrode.

According to the present invention there is provided a coating composition suitable for application to an electrically conducting and relatively inert substrate at least an outer layer of which is composed of titanium or a titanium alloy for the manufacture of a coated electrode for electrochemical processes, the composition containing thermally decomposable compounds of iridium and of at least one non noble element selected from among lithium, boron, beryllium, magnesium, gallium and germanium, in a liquid vehicle, the automatic proportions of iridium/non noble metal being 1/4 and 8/1.

The invention also provides an electrode for electrochemical processes provided with the above-described composition, and a process for fabricating such an electrode.

It has been found that such electrodes possess an improved resistance to corrosion by nascent chlorine, that they have a low overpotential for the liberation of chlorine, and that when used as anodes in mercury-cathode cells producing chlorine by the electrolysis of alkali metal chloride, they show excellent resistance to deterioration by contact with the mercury cathode.

Compared to electrodes obtained by the same technique but starting with a coating composition based on compounds of titanium and ruthenium, the electrodes according to the invention present a surface condition that is fundamentally different; their coating is smooth and uniform, and practically free from local irregularities, fissures, bare patches and other defects exhibited by the former coatings, as can be shown in a striking manner by means of photographs taken with a scanning electron microscope.

Although the analytical techniques employed have not provided evidence of the presence of lithium and of boron in the final coating after the thermal treatment, it is nonetheless clear that, by their presence along with the iridium in the coating composition applied to the substrate, they have a marked effect on the final structure of the coating and on the life of the electrodes provided with such coatings when they are used as anodes in the electrolysis of brine.

Investigations on the influence of lithium on the structure and the electrochemical properties of coatings consisting of metals of the platinum group have lead the applicants to the surprising finding that only coatings containing iridium or its oxides are significantly influenced by the presence of lithium in the composition.

In the present disclosure, by "a titanium alloy" is meant an alloy consisting substantially of titanium and having anodic polarization properties in the electrolyte where the electrode is to be used similar to those of commercially pure titanium, for example titanium-zirconium alloys containing up to 14% of zirconium, alloys of titanium with a noble metal containing up to 5% of a noble metal such as platinum, rhodium, palladium or iridium, and alloys of titanium with niobium or tantalum containing up to 10% of niobium or tantalum.

By "a thermally decomposable compound of iridium" is meant any compound of iridium which is decomposable to the metal and/or an oxide under the conditions of thermal treatment employed after application of the coating composition to the substrate, particularly the chloride, bromide, iodide, resinates and sulphonates of iridium and iridium carbonyl.

By "non noble element" is meant exclusively at least one of the metals Li, B, Be, Mg, Ga and Ge. Although other non noble elements having an ionic radius of less than 0.63 A can, a priori, be suitable from the point of view of resistance to corrosion by the nascent chlorine, they impart, however, to the coating an overpotential which is too high for industrial use. Non noble elements having an ionic radius greater than 0.63 A give rise either to unacceptably high overpotentials, or to a rate of coating consumption per ton of chlorine produced which is much too high, in all cases greater than 50mg of coating per ton of chlorine.

By "a thermally decomposable compound of a non noble element", is meant any compound of one of these elements which is decomposable into oxide under the thermal treatment conditions imposed after the application of the coating composition to the substrate, particularly the acetate, citrate, formiate, oxalate, bromide, carbonate, nitrate, chlorate, premanganate and tungstate of, or a grease containing, these elements.

By "a liquid vehicle", is meant any liquid medium which allows the formation of a relatively stable solution and/or suspension or dispersion of the thermally decomposable compounds of iridium and of the non noble element and which have a wetting power and viscosity compatible with the technique used for coating the substrate, especially amyl alcohol, butyl alcohol, isopropyl alcohol, dilute hydrochloric acid, propylene carbonate, dimethyl formamide, dimethyl sulphoxide alone or admixtures thereof. For lithium, amyl alcohol has been found to be very advantageous.

The atomic proportion of iridium/non noble element should be between 1/4 and 8/1 in the coating composition. If this proportion is less than 1/4, there are obtained, after thermal treatment, electrode coatings of which the electrocatalytic properties worsen in the course of time, particularly in the electrolysis of brines; if it exceeds 8/1, coatings are obtained which are less smooth, showing irregularities or fissures, and the protection of the substrate becomes uncertain. The most suitable atomic proportions of iridium/non noble element are between 1/1 to 5/1 for lithium; above 1/1 for boron, magnesium and gallium, and above 0.5 for beryllium.

In general, the coating composition is applied to a substrate which has first been submitted to chemical cleaning. The substrate is degreased if necessary, then etched by any known method such as electrolysis or immersion in a bath of molten salts or in an organic or inorganic solution of alkali or acid, but in general an immersion in an aqueous solution of oxalic acid or hydrochloric acid is preferred. Optionally, before application of the composition, the substrate thus etched may also be given an oxidizing treatment in order to form a thin surface layer of titanium oxide which assists anchorage of the coating.

Application of the coating composition to the substrate may be carried out by any effective technique such as brushing, pasting, spraying, atomizing or immersion. After evaporation of the liquid vehicle from the composition, the substrate thus coated is given a thermal treatment in an oxidizing atmosphere, preferably in air, between 350° C and 800° C so as to decompose the compounds of iridium and non noble element. Under these conditions, a large proportion of the iridium in the electrocatalytic coating is in the form of oxide. The duration of the thermal treatment depends on the chosen temperature. So as to avoid an unwanted reaction between the substrate and its coating or the oxygen in the air, the time of heating is preferably limited to fifteen minutes at a temperature of 500° C for example; at a temperature of 800° C, the thermal treatment will be considerably shorter and should not exceed several tens of seconds.

If necessary, the steps of coating and drying may be repeated so as to obtain the desired coating thickness after the thermal treatment. In this case, the thermal treatment may be carried out in a single step after applying and drying the last layer of coating composition or, particularly when the successive layers are relatively thick, it may be carried out on each layer directly after drying and before application of the succeeding layer, or yet again it may be carried out after application and drying of two or three layers. When a thermal treatment is carried out in several steps there is an advantage in increasing progressively the temperature of treatment from step to step.

If desired, the electrode thus obtained, consisting of a titanium or titanium alloy substrate and its protective electrocatalytic coating, may be further activated, especially for liberation of chlorine, by finally forming an external layer of active material comprising at least one noble metal in the elementary state or in the form of a compound, selected from platinum, palladium, ruthenium, rhodium, osmium and iridium. This external layer of active material may be formed by any suitable technique, such as that described in Belgian Patent No. 760,507 issued in the name of the present applicants. The external layer may include any compounds of noble metals which improve the electrocatalytic properties of the electrode, particularly those claimed in pending patent applications No. 61,433 and No. 61,436 filed in Luxembourg on July 29, 1970 in the name of the present applicants.

DESCRIPTION OF THE PREFERRED EMBODIMENTS

In a preferred embodiment of the invention the substrate of the electrode is made of titanium and the coating composition employed for making the electrode consists of a homogeneous solution of soluble compounds of iridium and of non noble element which is applied in several layers on the titanium substrate with intermediate thermal treatment at rising temperatures so as to obtain a final weight of coating of 2–12 g/m² of coated surface, after a final prolonged thermal treatment.

In the following examples, which are given solely by way of illustration and do not limit the scope of the invention, the electrodes obtained by coating plates of titanium by means of an iridium/non noble element composition were used as thus produced, without any supplementary activating layer, as anodes for the electrolysis of brine in a cell with a mercury cathode, where they showed overpotentials for the liberation of chlorine of the order of 300 mV and in any case less than 500 mV, with an anodic current density of 10 kA/m². In all cases the coating when submitted to a stripping test with adhesive tape showed good adherence to the substrate.

In each Example, the consumption of noble metal is expressed in a conventional manner by the ratio of the total weight of the coating in grams per square meter g of active anode surface to the weight of chlorine produced in tons ($tCl_2$) per square meter of this same active anode surface. Thus, the ratio can be expressed as g(coating)/m² : $tCl_2/m^2$, or $g/tCl_2$. It is estimated that a conventional consumption of the order of 60, and preferably less than 50, milligrams/$tCl_2$ is acceptable in the industry. Since this represents an upper limit, the actual consumption of noble metal (iridium) is always less than the conventional consumption indicated above.

The test for each anode is halted when the current density falls to less than 50% of its initial value.

The compositions given below, by way of example, include only one non noble element chosen from among Li, B, Be, Mg, Ga, and Ge, but is is obvious that the invention applies also to compositions containing more than one of these elements.

EXAMPLE 1

A solution containing 0.1 g-atom Li/1 (solution A) was prepared by dissolving lithium nitrate in dimethyl formamide.

Also a solution was separately prepared containing 0.1 g-atom Ir/1 (solution B) by dissolving hexachloroiridic acid in the same solvent.

These two solutions were mixed in the necessary proportions to obtain a coating composition containing 1 g-atom Ir to 2 g-atom Li.

Titanium plates previously etched for five hours at 80° C in an aqueous solution of 10% oxalic acid were placed on a hot plate heated to 70°-80° C. Five coats of the prepared composition were applied to these plates by brushing, each coat being followed, after evaporation of the solvent on the hot plate, by a thermal treatment for 15 minutes in air at temperatures respectively of 350°, 375°, 400°, 425° and 450° C. Finally the plates were given a thermal treatment for 5 hours at 475° C in the presence of air and were then allowed to cool in air. The quantity of material thus deposited was about 4.8 g/m$^2$.

The plates thus coated were submitted as anodes to a test for consumption of the coating in a cell with a flowing mercury cathode for the electrolysis of brine saturated with sodium chloride and chlorine between 80° and 85° C, at a constant anode-cathode potential difference.

Under these conditions the tested plates produced 110 and 128 tons of chlorine/m$^2$ of active anode surface after 200 and 255 days, respectively, of uninterrupted operation at an average anodic current density of about 18 kA/m$^2$. The consumption of iridium is less than 38 mg/ton of chlorine produced.

EXAMPLE 2

By mixing the necessary proportions of solutions A and B of Example 1, a coating composition was obtained containing 2 g-atom Ir to 1 g-atom Li, which was applied to titanium plates under the same conditions as in Example 1. The thermal treatments were also carried out in the same manner as in Example 1. The quantity of material thus deposited was about 4.8 g/m$^2$.

When submitted to the test for consumption of the coating under the same conditions as in Example 1, the plates thus coated produced 119 and 171 tons of chlorine/m$^2$ of active anode surface for 200 and 300 days, respectively, of uninterrupted operation at an average anodic current density of about 20 kA/m$^2$. The consumption of iridium is less than 28 mg/ton of chlorine produced.

EXAMPLE 3

By mixing the solutions A and B of Example 1 in the required proportions a coating composition was obtained containing 2 g-atom Ir to 1 g-atom Li, which was applied to plates of titanium under the same conditions as in Example 1. The thermal treatments were also carried out as in Example 1. The quantity of material thus deposited was about 4.7 g/m$^2$.

When submitted to the test for consumption of the coating under the same conditions as in Example 1, the plates thus coated produced 78 and 138 tons of chlorine/m$^2$ of active anode surface after 112 and 230 days, respectively, of uninterrupted operation at an average anodic current density of about 22 kA/m$^2$. The consumption of iridium is less than 34 mg/ton of chlorine produced.

EXAMPLE 4

By mixing the solutions A and B of Example 1 in the required proportions, a coating composition was obtained containing 3 g-atom Ir to 2 g-atom Li, which was applied to plates of titanium under the same conditions as in Example 1. The thermal treatments were also carried out in the manner of Example 1. The quantity of material thus deposited was about 3.7 g/m$^2$.

When submitted to the test for consumption of the coating under the same conditions as in Example 1, the plates thus coated produced 68 and 90 tons of chlorine/m$^2$ of active anode surface after 112 and 176 days, respectively, of uninterrupted operation at an average anodic current density of about 21 kA/m$^2$. The consumption of iridium is less than 41 mg/ton of chlorine produced.

EXAMPLE 5

By mixing the solutions A and B of Example 1 in the desired proportions a coating composition was obtained containing 1 g-atom Ir to 1 g-atom Li, which was applied to plates of titanium under the same conditions as in Example 1. The thermal treatments were also carried out in the manner of Example 1. The quantity of material thus deposited was about 3.4 g/m$^2$.

When submitted to the test for consumpiton of the coating under the same conditions as in Example 1, the plates thus coated produced 78 and 89 tons of chlorine/m$^2$ of active anode surface after 112 and 176 days, respectively, of uninterrupted operation at an average anodic current density of about 19 kA/m$^2$. The consumption of iridium is less than 38 mg/ton of chlorine produced.

EXAMPLE 6

By mixing the solutions A and B of Example 1 in the necessary proportion a coating composition was obtained containing 1 g-atom Ir to 2 g-atom Li, which was applied to titanium plates under the same conditions as in Example 1. The thermal treatments were also carried out in the manner of Example 1. The amount of material thus deposited was about 4.0 g/m$^2$.

When submitted to the test for consumption of the coating under the same conditions as in Example 1, the plates thus coated produced 53 and 63 tons of chlorine/m$^2$ of active anode surface after 112 and 140 days, respectively, of uninterrupted operation at an average anodic current density of about 18 kA/m$^2$. The consumption of iridium is less than 63 mg/ton of chlorine produced.

EXAMPLE 7

By mixing the solutions A and B of Example 1 in the desired proportions a coating composition was obtained containing 1 g-atom Ir to 2 g-atom Li, which was applied to plates of titanium under the same conditions as in Example 1. The thermal treatments were also carried out in the manner of Example 1. The amount of material thus deposited was about 3.0 g/m².

When submitted to the test for consumption of the coating under the same conditions as in Example 1, the plates thus coated produced 44 and 65 tons of chlorine/m² of active anode surface after 84 and 150 days, respectively, of uninterrupted operation at an average anodic current density of about 18 kA/m². The consumption of iridium is less than 46 mg/ton of chlorine produced.

EXAMPLE 8

By mixing the solutions A and B of Example 1 in the desired proportions, a coating composition was obtained containing 2 g-atom Ir to 1 g-atom Li, which was applied to plates of titanium under the same conditions as in Example 1. The thermal treatments were also carried out in the manner of Example 1. The amount of material thus deposited was about 2.4 g/m².

When submitted to the test for consumption of the coating under the same conditions as in Example 1, the plates thus treated produced 54 and 75 tons of chlorine/m² of active anode surface after 84 and 150 days, respectively, of uninterrupted operation at an average anodic current density of about 21 kA/m². The consumption of iridium is less than 32 mg/ton of chlorine produced.

EXAMPLE 9

A solution was prepared containing 0.1 g-tom Li/1 (solution C) by dissolving lithium nitrate in amyl alcohol. A solution containing 0.1 g-atom Ir/1 was separately prepared (solution D) by dissolving hexachloroiridic acid in the same solvent.

These two solutions were mixed in the proportion necessary to obtain a coating composition containing 3 g-atom Ir to 2 g-atom Li, which was applied to plates of titanium under the same conditions as in Example 1. The thermal treatments were also carried out in the manner of Example 1. The amount of material thus deposited was about 5.0 g/m².

When submitted to the test for consumption of the coating under the same conditions as in Example 1, the plates thus coated produced 29 and 233 tons of chlorine/m² of active anode surface after 45 and 390 days, respectively, of uninterrupted operation at an average anodic current density of about 22 kA/m². At this time the limit of useful life of the electrode had not yet been reached and the consumption test was continued, but it was already apparent that the consumption of iridium would be less than 21 mg/ton of chlorine produced.

EXAMPLE 10

By mixing the solutions C and D of Example 9 in the required proportions, a coating composition was obtained containing 2 g-atom Ir to 1 g-atom Li, which was applied to plates of titanium under the same conditions as in Example 1. The thermal treatments were also carried out in the manner of Example 1. The amount of material thus deposited was about 5.9 g/m².

When submitted to the test for consumption of the coating under the same conditions as in Example 1, the plates thus coated have to date produced 28 and 221 tons of chlorine/m² of active anode surface after 45 and 390 days, respectively, of uninterrupted operation at an average anodic current density of about 21 kA/m². At this time the useful life of the electrode had not yet been reached and the consumption test was continued, but it was already apparent that the consumption of iridium would be less than 27 mg/ton of chlorine produced.

COMPARATIVE EXAMPLE R1

By dissolving ruthenium chloride in dimethyl formamide a solution containing 0.1 g-atom Ru/1 was prepared, to which was added the necessary proportions of solution A of Example 1 to obtain a coating composition containing 2 g-atom Ru to 1 g-atom Li, which was applied to plates of titanium under the same conditions as in Example 1. The thermal treatments were also carried out in the manner of Example 1. The amount of material thus deposited was about 4.7 g/m².

When submitted to the test for consumption of the coating under the same conditions as in Example 1, the plates thus coated produced 23 tons of chlorine/m² of active anode surface after 45 days of uninterrupted operation at an average anodic current density of about 18 kA/m². The consumption of ruthenium is less than 155 mg/ton of chlorine produced, at the end of 45 days, but because the current density fell too rapidly, this type of anode was ruled out.

COMPARATIVE EXAMPLE R2

By dissolving hexachloroplatinic acid in dimethyl formamide a solution containing 0.1 g-atom Pt/1 was prepared to which was added the required proportion of solution A of Example 1 to obtain a coating composition containing 3 g-atom Pt to 2 g-atom Li, which was applied to plates of titanium under the same conditions as in Example 1. The thermal treatments were also carried out in the manner of Example 1. The amount of material thus deposited was about 3.0 g/m².

When submitted to the test for consumption of the coating under the same conditions as in Example 1, the plates thus coated showed an unstable current density which did not cease decreasing. The current density having fallen below 50% of its initial value, the test was stopped after only five days of operation. At this time the total amount of chlorine produced during the life of the electrode was 2 tons/m² of active anode surface, which gives a consumption of noble metal of 1300 mg/ton of chlorine produced, assuming that the coating consists entirely of $PtO_2$.

COMPARATIVE EXAMPLE R3

By dissolving ammonium hexachloropalladate in dimethyl formamide a solution containing 0.1 g-atom Pd/1 was prepared to which was added the required proportion of solution A of Example 1 to obtain a coating composition containing 3 g-atom Pd to 2 g-atom Li, which was applied to plates of titanium under the same conditions as in Example 1. The thermal treatments were also carried out in the manner of Example 1. The amount of material thus deposited was about 2.7 g/m².

Submitted to the test for consumption of the coating under the same conditions as in Example 1, the plates thus treated showed an unstable current density which did not cease decreasing. The current density having fallen below 50% of its initial value, the test was stopped after only five days of operation. At this time the total amount of chlorine produced during the life of the electrode was 1.9 tons/m² of active anode surface, which gives a consumption of noble metal of 1200 mg/ton of chlorine produced, assuming that the coating consists entirely of PdO.

The data of the illustrative Examples 1–10 and the Comparative Examples R1, R2 and R3 are collected together in the following table I.

Table I

| Ex. No. | Atomic Proportion in Coating Composition | Solvent Employed | Wt. of Coating g/m² | Anodic Current Density kA/m² Initial | Last Measurement | Actual Life of Anode Days | Actual Chlorine Produced $tCl_2/m^2$ | Noble Metal Consumed mg/ton $Cl_2$ |
|---|---|---|---|---|---|---|---|---|
| 1 | 1 Ir/2 Li | DMF (a) | 4.8 | 18 | 18 | 200 | 110 | <43 |
| | | | | | 15 | 255 | 128.3 | <38 |
| 2 | 2 Ir/1 Li | " | 4.8 | 20 | 21 | 200 | 119 | <40 |
| | | | | | 19 | 300 | 171 | <28 |
| 3 | 2 Ir/1 Li | " | 4.7 | 20 | 24 | 112 | 78 | <60 |
| | | | | | 21 | 230 | 138 | <34 |
| 4 | 3 Ir/2 Li | " | 3.7 | 27 | 20 | 112 | 68 | <54 |
| | | | | | 18 | 176 | 90 | <41 |
| 5 | 1 Ir/1 Li | " | 3.4 | 17 | 20 | 112 | 78 | <44 |
| | | | | | 15 | 176 | 89 | <38 |
| 6 | 1 Ir/2 Li | " | 4.0 | 21 | 14 | 112 | 53 | <75 |
| | | | | | 12 | 140 | 63 | <63 |
| 7 | 1 Ir/2 Li | " | 3.0 | 17 | 18 | 84 | 44 | <68 |
| | | | | | 16 | 150 | 65 | <46 |
| 8 | 2 Ir/1 Li | " | 2.4 | 28 | 22 | 84 | 54 | <45 |
| | | | | | 13 | 150 | 75 | <32 |
| 9 | 3 Ir/2 Li | amyl alcohol | 5.0 | 21 | 22 | 45 | 29 | <170 |
| | | | | | 23 | 390 | 233 | <21 |
| 10 | 2 Ir/1 Li | " | 5.9 | 20 | 23 | 45 | 28 | <210 |
| | | | | | 22 | 390 | 221 | <27 |
| R1 | 2 Ru/1 Li | DMF (a) | 4.7 | 22 | 13 | 45 | 23 | <155 |
| R2 | 3 Pt/2 Li | " | 3.0 | 16 | 7 (b) | 5 (b) | 2 (b) | <1300 (b) |
| R3 | 3 Pd/2 Li | " | 2.7 | 22 | 4 (b) | 5 (b) | 1.9 (b) | <1200 (b) |

(a) Dimethylformamide
(b) This anode is no longer operating, its current density having fallen below 50% of its initial value.

EXAMPLE 11: Ir/B=6

A solution containing 0.05 g-atom Ir/1 and a solution containing 0.01 g-atom B/1 were prepared by separately dissolving, at low temperature, chloroiridic acid ($H_2IrCl_6.xH_2L$) and boric acid ($H_3BO_3$) in amyl alcohol. These two solutions were then mixed in the necessary proportions to obtain a mixture in which the ratio of Ir/B was equal to 6.

Several layers of this composition were applied by brushing to plates of titanium which had been preliminarily degreased at high temperature in trichlorethylene and etched for 4–5 hours at about 90° C in an aqueous solution of 10% oxalic acid.

Eight layers of this composition were applied at low temperature to the titanium plates, which had been dried in air and heated to 400° C for 5 minutes after each application. After the eighth application, they were subjected to a final thermal treatment lasting 5 hours at 500° C followed by a cooling in the furnace. The result was a coating having a thickness of 7.1g per square meter of surface, the coating adhering firmly to the substrate and withstanding stripping tests performed by an adhesive ribbon applied under pressure. In addition, in the adherence test this coating proved superior to a coating having a base of iridium and obtained from a paint containing only iridium, and thus free of boron.

The thus coated titanium plates were subjected as anodes to two different tests: one for the determination of the overpotential for the liberation of chlorine at a fixed anode current density (10 kA/m²); the other for the determination of the consumption of noble metal as a function of the quantity of chlorine liberated.

For the overpotential test, the plates were utilized as anodes for the electrolysis of brine containing 250 g NaCl/kg, saturated with chlorine, at 60° C and with a pH of about 2. Under these conditions, the plates of this example presented an initial overpotential of 160 mV at an anode current density of 10 kA/m².

On the other hand, for the consumption test, the plates are utilized as anodes in a cell with a flowing mercury cathode for the electrolysis of a brine saturated in sodium chloride and chlorine, between 80° and 85° C, with a cathode-anode potential difference which is maintained constant, the test being halted after an overpotential value of about 500 mV. Under these conditions, the plates tested produced 259 tons of chlorine per square meter of active surface. They indicated a consumption of iridium of less than 28 mg, i.e., of the order of 20 mg per ton of chlorine produced at an average current density of 25 kA/m².

EXAMPLE 12: Ir/B=4

The same solutions of iridium and boron as in Example 11 were utilized and they were mixed together in the necessary proportions to obtain a ratio of Ir/B=4.

Twelve layers of this composition were applied to plates of titanium under the same conditions as in Example 11. There was thus obtained a coating having a thickness of 7.7 g/m², and presenting a good adherence in stripping tests employing an adhesive ribbon.

In the overpotential test carried out under the same conditions as in Example 11, the plates thus coated presented an overpotential of 170 mV at an anode current density of 10 kA/m².

In the consumption test, also carried out under the conditions defined in Example 11, these plates produced 241 tons $Cl_2/m^2$ at an average current density of 25 kA/m² and the consumption of Ir was of the order of 25 mg/ton $Cl_2$, and in any case less than 32 mg/t $Cl_2$.

EXAMPLE 13: Ir/B=1

The same solution of 0.05 g-atom Ir/1 as in Example 11 was utilized and was mixed with an alcoholic boric acid solution titrating at 0.01 g-atom B/1 in the necessary proportions to obtain a ratio of Ir/B=1.

Twelve layers of this composition were applied to plates of titanium disposed on a heating plate at 90°–100° C, the plates being dried in the air for 5 minutes and heated to 400° C for 15 minutes after each coat. They were subjected to a final thermal treatment for 16 hours at 500° C. The result was a coating composed of 6 g/m² of material and presenting a good adherence.

In the overpotential test carried out under the same conditions as in Example 11, the plates thus coated presented an initial overpotential of 176 mV at a current density of 10 kA/m². In the consumption test, also carried out under the conditions defined in Example 11, these same plates produced 195 tons $Cl_2/m^2$ at an average anode current density of 22 kA/m² and the consumption of Ir was of the order of 20 mg/t $Cl_2$, and in any case less than 31 mg/t $Cl_2$.

The data for Example 1 are set forth in table II below.

Table II

| Ex. No. | Atomic Proportion in coating Composition | Solvent Employed | Wt. of Coating g/m² | Ir + B Anodic Current Density kA/m² Initial | Last Measurement | Actual Life of Anode Days | Actual Chlorine Produced $tCl_2/m^2$ | Noble Metal Consumed mg/ton $Cl_2$ |
|---|---|---|---|---|---|---|---|---|
| 11 | 6 Ir/1 B | amyl alcohol | 7.1 | 26 | 24 | 374 | 259 | <28 |
| 12 | 4 Ir/1 B | " | 7.7 | 26 | 24 | 359 | 241 | <32 |
| 13 | 1 Ir/1 B | " | 6 | 23 | 21 | 318 | 195 | <31 |

EXAMPLE 14 - 28

These examples concern coating compositions containing iridium and an element selected from among Be, Mg, Ga and Ge.

A solution of 0.1 mol Ir/1 was prepared by dissolving hexachloroiridic acid ($H_2IrCl_6.xH_2O$) in dimethyl formamide (DMF) for mixture with solutions of Be, Mg and Ga, while for mixture with a solution of Ge, the hexachloroiridic acid was dissolved in isopropyl alcohol. There were also prepared separate solutions of:

- 0.1 mol Be/1 by dissolving beryllium nitrate ($Be(NO_3)_2$) in DMF
- 0.1 mol Mg/1 by dissolving magnesium acetate tetrahydrate ($Mg(CH_3COO)4H_2O$) in DMF
- 0.1 mol Ga/1 by dissolving trihydrated gallium nitrate ($Ga(NO_3)_3.3H_2O$) in DMF
- 0.1 mol Ge/1 by dissolving germanium tetrachloride in isopropyl alcohol ($GeCl_4$ reacting with DMF).

At the moment of use, the two selected solutions, one containing Ir, and the other being one of the solutions of Be, Mg, Ga and Ge, were mixed in the necessary proportions. Several layers of the resulting mixture were applied, by brushing, to plates of titanium (Contimet 35) which had been previously degreased at high temperature in trichlorethylene and etched for five hours at 80° C by an aqueous solution of 10% oxalic acid. Five layers were applied to each of the titanium plates disposed on a heating plate at 70°-80° C. After each coat, these plates were dried in air for 5 minutes and thermally treated for fifteen minutes at respective temperatures of 350°, 400°, 425° and 450° C. Finally the plates were subjected to a final thermal treatment for five hours at 475° C. The results obtained with mixtures containing Be, Mg, Ga and Ge are set forth in respective groups in Table III below.

Table III

| Ex. No. | Atomic Proportion in Coating Composition | Solvent Employed | Wt. of Coating g/m² | Anodic Current Density kA/m² Initial | Last Measurement | Actual Life of Anode Days | Actual Chlorine Produced $tCl_2/m^2$ | Noble Metal Consumed mg/ton $Cl_2$ |
|---|---|---|---|---|---|---|---|---|
| | | | | Ir/Be | | | | |
| 14 | 4 Ir/1 Be | DMF | 2.4 | 22 | 16 | 89 | 50 | 48 |
| 15 | 3 Ir/2 Be | " | 3.8 | 24 | 20 | 210 | 139 | 27.4 |
| 16 | 1 Ir/1 Be | " | 3.4 | 27 | 19 | 180 | 120 | <28 |
| 17 | 3 Ir/2 Be | " | 3 | 23 | 17 | 150 | 90 | 33.5 |
| 18 | 2 Ir/1 Be | " | 3.5 | 23 | 21 | 195 | 122 | <28.7 |
| | | | | Ir/Mg | | | | |
| 19 | 1 Ir/1 Mg | DMF | 3.7 | 31 | 26 | 125 | 107 | <34 |
| 20 | 1 Ir/1 Mg | " | 3.8 | 28 | 22 | 125 | 94 | <40 |
| 21 | 2 Ir/1 Mg | " | 6.1 | 24 | 22 | 345 | 220 | <27 |
| 22 | 2 Ir/1 Mg | " | 3.2 | 25 | 26 | 125 | 95 | <33 |
| 23 | 2 Ir/1 Mg | " | 3.8 | 32 | 28 | 125 | 113 | <33 |
| | | | | Ir/Ga | | | | |
| 24 | 2 Ir/1 Ga | DMF | 3.9 | 24 | 16 | 147 | 76 | <51 |
| 25 | 2 Ir/1 Ga | " | 6.1 | 27 | 27 | 355 | 260 | <23 |
| 26 | 2 Ir/1 Ga | " | 3.5 | 23 | 16 | 85 | 71 | <50 |
| | | | | Ir/Ge | | | | |
| 27 | 1 Ir/2 Ge | isopropyl alcohol | 10 | 23 | 19 | 390 | 225 | <44 |
| 28 | 3 Ir/2 Ge | " | 11.7 | 25 | 18 | 370 | 242 | <48 |

It will be understood that the above description of the present invention is susceptible to various modifications, changes and adaptations, and the same are intended to be comprehended within the meaning and range of equivalents of the appended claims.

We claim:

1. In an electrode for electrochemical processes having an electrically conductive and relatively inert support at least the surface layer of which is of titanium or a titanium alloy, and an at least partial coating for said support, said coating being a protective and electrocatalytic layer obtained by heating on said support, in an oxidizing atmosphere at a temperature between 350° and 800° C, a coating composition consisting essentially of at least one thermally decomposable compound of iridium in a liquid vehicle, said iridium compound decomposing during the heating of the coating composition to provide said iridium in a metallic and/or oxide state, and at least one thermally decomposable compound of a non noble element selected from the group consisting of lithium, boron, beryllium and gallium in an atomic ratio iridium/non noble element of 1/4 to 8/1, said thermally decomposable compound of the non noble element decomposing during the heating of the coating composition to an oxide of the non noble element.

2. An electrode as defined in claim 1, wherein the thermally decomposable compound of iridium is hexachloroiridic acid.

3. An electrode as defined in claim 1, wherein the liquid vehicle is amyl alcohol.

4. An electrode as defined in claim 1, wherein the liquid vehicle is dimethyl formamide.

5. An electrode as defined in claim 1, wherein the atomic ratio of iridium/non noble element in said coating composition is between 1/1 and 5/1.

6. An electrode as defined in claim 1, wherein the non noble element is boron, the thermally decomposable compound of boron is boric acid, the liquid vehicle is amyl alcohol, and the atomic ratio of iridium/boron in said coating composition is greater than 1.

7. An electrode as defined in claim 1, further comprising an external layer of active material for further increasing the electrocatalytic properties of said electrode, said external layer being on and in contact with said coating and comprising at least one noble metal in its elemental and/or combined state and selected from a group consisting of platinum, palladium, ruthenium, rhodium, osmium and iridium.

8. In an electrode for electrochemical processes having an electrically conductive and relatively inert support at least the surface layer of which is of titanium or a titanium alloy, and an at least partial coating for said support, said coating being a protective and electrocatalytic layer obtained by heating on said support, in an oxidizing atmosphere at a temperature between 350° and 800° C, a coating composition consisting essentially of at least one thermally decomposable compound of iridium in a liquid vehicle, said iridium compound decomposing during the heating of the coating composition to provide said iridium in a metallic and/or oxide state, and at least one thermally decomposable compound of lithium, in an atomic ratio iridium/lithium of 1/4 to 8/1, said thermally decomposable compound of lithium decomposing during the heating of the coating composition to an oxide of lithium.

9. An electrode s defined in claim 8, wherein the thermally decomposable compound of lithium is lithium nitrate.

10. In an electrode for electrochemical processes having an electrically conductive and relatively inert support at least the surface layer of which is of titanium or a titanium alloy, and an at least partial coating for said support, said coating being a protective and electrocatalytic layer obtained by heating on said support, in an oxidizing atmosphere at a temperature between 350° and 800° C, a coating composition consisting essentially of at least one thermally decomposable compound of iridium in a liquid vehicle, said iridium compound decomposing during the heating of the coating composition to provide said iridium in a metallic and/or oxide state, and at least one thermally decomposable compound of a non noble element selected from the group consisting of lithium and boron, in an atomic ratio iridium/non noble element of 1/4 to 8/1, said thermally decomposable compound of the non noble element decomposing during the heating of the coating composition to an oxide of the non noble element.

11. In an electrode for electrochemical processes having an electrically conductive and relatively inert support at least the surface layer of which is of titanium or a titanium alloy, and an at least partial coating for said support, said coating being a protective and electrocatalytic layer obtained by heating on said support, in an oxidizing atmosphere at a temperature between 350° and 800° C, a coating composition consisting essentially of at least one thermally decomposable compound of iridium in a liquid vehicle, said iridium compound decomposing during the heating of the coating composition to provide said iridium in a metallic and/or oxide state, and at least one thermally decomposable compound of beryllium, in an atomic ratio iridium/beryllium of 1/4 to 8/1, said thermally decomposable compound of beryllium decomposing during the heating of the coating composition to an oxide of beryllium.

12. In an electrode for electrochemical processes having an electrically conductive and relatively inert support at least the surface layer of which is of titanium or a titanium alloy, and an at least partial coating for said support, said coating being a protective and electrocatalytic layer obtained by heating on said support, in an oxidizing atmosphere at a temperature between 350° and 800° C, a coating composition consisting essentially of at least one thermally decomposable compound of iridium in a liquid vehicle, said iridium compound decomposing during the heating of the coating composition to provide said iridium in a metallic and/or oxide state, and at least one thermally decomposable compound of gallium, in an atomic ratio iridium/gallium of 1/4 to 8/1, said thermally decomposable compound of gallium decomposing during the heating of the coating composition to an oxide of gallium.

* * * * *